US012693038B2

(12) United States Patent
Yamamoto et al.

(10) Patent No.: US 12,693,038 B2
(45) Date of Patent: Jul. 28, 2026

(54) AIR CONDITIONING SYSTEM

(71) Applicant: DAIKIN INDUSTRIES, LTD., Osaka (JP)

(72) Inventors: Ryosuke Yamamoto, Osaka (JP); Kazuaki Ando, Osaka (JP); Shin Higashiyama, Osaka (JP); Daisuke Noburyu, Osaka (JP); Keiya Nagahara, Osaka (JP); Yuki Murakami, Osaka (JP); Masahiro Kaneko, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 43 days.

(21) Appl. No.: 18/801,869

(22) Filed: Aug. 13, 2024

(65) Prior Publication Data

US 2024/0401829 A1 Dec. 5, 2024

Related U.S. Application Data

(63) Continuation of application No. PCT/JP2023/001875, filed on Jan. 23, 2023.

(30) Foreign Application Priority Data

Feb. 16, 2022 (JP) ..... 2022-021835

(51) Int. Cl.
*F24F 11/36* (2018.01)
*F24F 11/52* (2018.01)
*F24F 11/56* (2018.01)

(52) U.S. Cl.
CPC ..... *F24F 11/36* (2018.01); *F24F 11/52* (2018.01); *F24F 11/56* (2018.01)

(58) Field of Classification Search
CPC .. F24F 11/36; F24F 11/52; F24F 11/54; F24F 11/56; F24F 11/64; F24F 11/89;
(Continued)

(56) References Cited

U.S. PATENT DOCUMENTS 6,026,652 A * 2/2000 Wada ..... F24F 11/63 236/51
2018/0283725 A1 10/2018 Ikawa et al.
(Continued)

FOREIGN PATENT DOCUMENTS

JP 2019-174110 A 10/2019
JP 6613734 B2 12/2019
WO 2020/110216 A1 6/2020

OTHER PUBLICATIONS

English translation of the International Preliminary Report On Patentability (Chapter I) mailed on Aug. 29, 2024, in corresponding PCT/JP2023/001875, 5 pages.
(Continued)

*Primary Examiner* — Dionne Pendleton
(74) *Attorney, Agent, or Firm* — XSENSUS LLP

(57) ABSTRACT

An air conditioning system includes a first device, a second device, a refrigerant sensor that is provided in the second device and detects a refrigerant leaking from the second device, and a first notification device that makes a notification of a refrigerant leak, in which the first device and the second device share first identification information that specifies a first group including the first notification device and the first device, the second device transmits leak detection information and the first identification information to the first device on the basis of detection of the refrigerant leak by the refrigerant sensor, and the first device instructs the first notification device to make a notification of the refrigerant leak on the basis of reception of the leak detec-
(Continued)

tion information and the first identification information that matches identification information of a group to which the first device belongs.

10 Claims, 7 Drawing Sheets

(58) Field of Classification Search
CPC ..... F24F 1/0047; F24F 1/0057; F24F 1/0071; F24F 1/0083; F24F 11/0001; F24F 11/526; F24F 11/74; F24F 11/77; F24F 3/14; F24F 11/30; F24F 11/63; F24F 11/70; F24F 11/88; F24F 2011/0002; F24F 2110/10; F24F 11/65; F24F 11/72; F24F 3/08; Y02B 30/70; F25B 2500/222; F25B 2313/0314; F25B 2600/2513; F25B 49/02; F25B 49/027; F25B 13/00; F25B 2313/0233; F25B 2313/0253; F25B 2313/0293; F25B 2400/075; F25B 49/005; F04B 15/02; F04B 2201/0208; F04B 23/06; F04B 47/02; F04B 49/007; F04B 49/065; E21B 2200/22; E21B 43/2607; A24F 15/015; A24F 40/10; A24F 40/42; A24F 40/46; A24F 40/51; A24F 40/53; A24F 40/57; A24F 40/80; A24F 40/95; A24F 47/00; G06N 20/00; G06N 5/04; G05D 23/1917; G05D 23/1925; G05D 23/20; B01J 19/0013; B01J 2219/00155; B01D 45/06; B01D 45/16; B01D 46/003; B01D 50/20; B01D 53/265; B60H 1/00385; B60H 1/00392; B60H 1/00764; B60H 1/008; B60H 1/00849; B60H 1/00978; C12M 23/28; C12M 41/02; C12M 41/12; C12M 41/22; C12M 41/34; B60L 3/00; B60L 3/0053; B60L 58/30; Y02E 60/50; Y02T 10/70; Y02T 90/40; Y10T 137/7761; G05B 19/042; G05B 2219/25252; G05B 2219/2614
See application file for complete search history.

(56) References Cited

U.S. PATENT DOCUMENTS

| | | | | |
|---|---|---|---|---|
| 2019/0017718 | A1* | 1/2019 | Suzuki | F24F 11/74 |
| 2019/0346166 | A1* | 11/2019 | Koizumi | F24F 11/89 |
| 2021/0199360 | A1 | 7/2021 | Watanabe et al. | |

OTHER PUBLICATIONS

Extended European search report issued on Apr. 14, 2025, in corresponding European patent Application No. 23756096.6, 11 pages.
International Search Report and Written Opinion mailed on Apr. 18, 2023, received for PCT Application PCT/JP2023/001875, filed on Jan. 23, 2023, 8 pages including English Translation.

* cited by examiner 1
22
L1
11
(11A)
L1
L1
L1
L2
21
L1
L2
L2
L1
L2
21
L1
L2
L2
L1
L2
21
L1
L2
L2

AIR CONDITIONING SYSTEM

CROSS-REFERENCE TO RELATED APPLICATIONS

This is a continuation application of PCT/JP2023/001875, filed on Jan. 23, 2023, which is based on and claims priority to Japanese Patent Application No. JP 2022-021835 filed on Feb. 16, 2022. The entire contents of the above-identified applications, including the specifications, drawings and claims, are incorporated herein by reference in their entirety.

TECHNICAL FIELD

The present disclosure relates to an air conditioning system.

BACKGROUND ART

Patent Literature 1 below discloses an air conditioner in which an outdoor unit and a plurality of indoor units are connected via refrigerant pipes. A common remote controller is connected to the plurality of indoor units, and the plurality of indoor units is operated by the remote controller.

Each of the indoor units of the air conditioner described in Patent Literature 1 is provided with a refrigerant sensor that detects a leaking refrigerant. When the refrigerant sensor detects a leaking refrigerant, a notification of occurrence of the refrigerant leak is made to a display unit or the like of the remote controller.

CITATION LIST

Patent Literature

PATENT LITERATURE 1: International Patent Publication No. 2020/110216

SUMMARY

An air conditioning system of the present disclosure includes a first device, a second device that is communicably connected to the first device and through which a refrigerant flows, a refrigerant sensor that is provided in the second device and detects a refrigerant leaking from the second device, and a first notification device that is communicably connected to the first device and makes a notification of a refrigerant leak, in which the first device and the second device share first identification information that specifies a first group including the first notification device and the first device, the second device transmits leak detection information and the first identification information to the first device on the basis of detection of the refrigerant leak by the refrigerant sensor, and the first device instructs the first notification device to make a notification of the refrigerant leak on the basis of reception of the leak detection information and the first identification information that matches identification information of a group to which the first device belongs.

DETAILED DESCRIPTION

Embodiments of an air conditioning system will be described in detail below with reference to the accompanying drawings.

Figure 1:
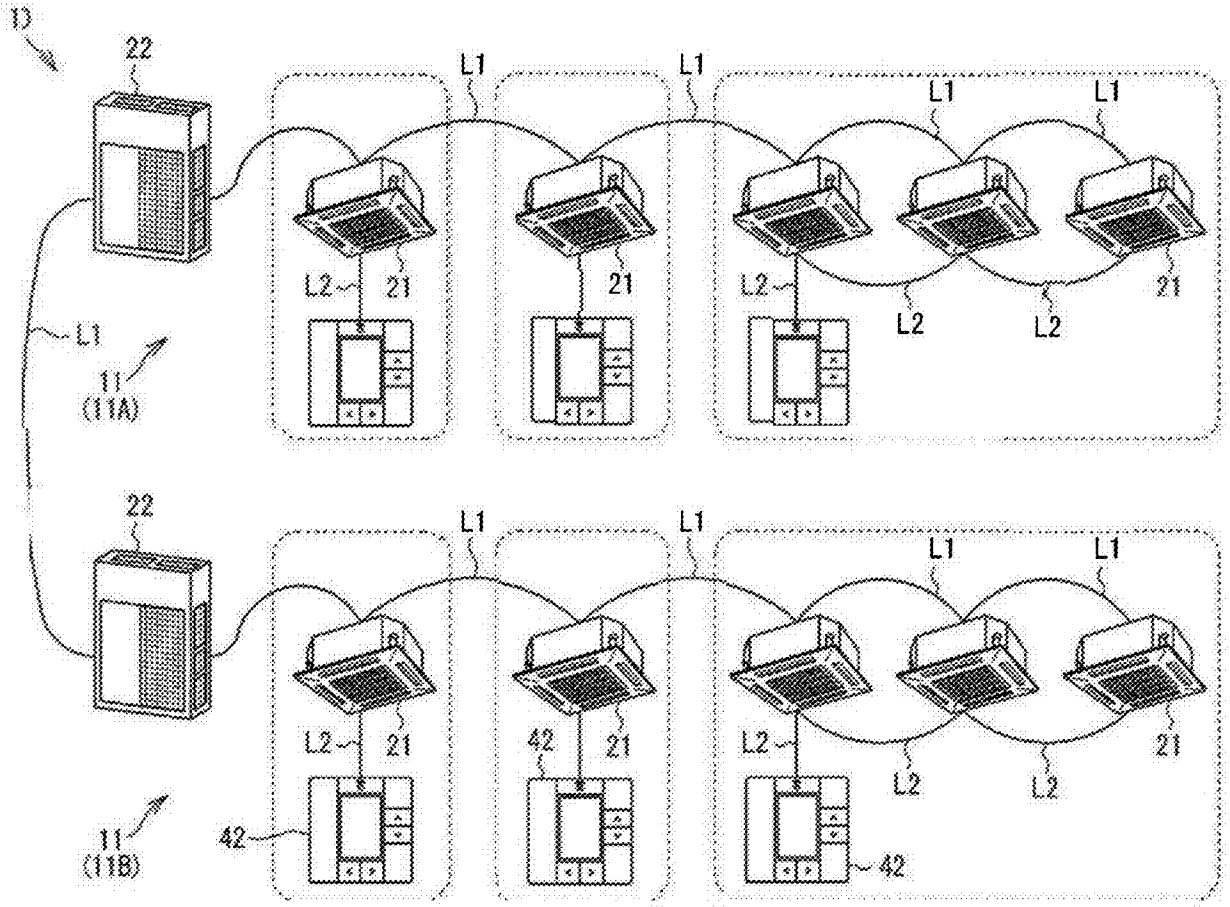
FIG. 1 is an overall configuration diagram of an air conditioning system according to an embodiment of the present disclosure.

FIG. 1 is an overall configuration diagram of an air conditioning system according to an embodiment of the present disclosure.

An air conditioning system 10 according to the present embodiment is installed in, for example, a building. The air conditioning system 10 includes an air conditioner including an indoor unit 21 installed inside a building and an outdoor unit 22 installed outside the building. FIG. 1 shows an air conditioner 11A that operates in a first refrigerant system and an air conditioner 11B that operates in a second refrigerant system.

In each refrigerant system, the outdoor unit 22 of the air conditioner 11 and a plurality of the indoor units 21 are communicably connected by a first communication line L1. The outdoor unit 22 of the first refrigerant system and the outdoor unit 22 of the second refrigerant system are also communicably connected by the first communication line L1. In the communication through the first communication line L1, a communication method (first communication method) is adopted in which individual communication between the outdoor unit 22 and the indoor units 21 is possible in each refrigerant system, and simultaneous transmission (so-called broadcast) of information from a device of any of the indoor units 21 and the outdoor unit 22 to another device is possible in all the refrigerant systems.

In each refrigerant system, a remote controller 42 is connected to any of the indoor units 21. The remote controller 42 is used to turn on and off operations of the indoor units 21 and the outdoor unit 22 and input operations of a set temperature and the like. In the present embodiment, as indicated by surrounding a dotted frame in FIG. 1, one remote controller 42 and the indoor unit 21 connected to the remote controller 42 form one group, and the air conditioning system 10 can control the operation of the indoor unit 21 for each group. One indoor unit 21, which is generally called a "master unit" and serves a representative, is defined in each group.

In each group, the indoor unit 21 and the remote controller 42 are communicably connected by a second communication line L2. In the communication through the second communication line L2, a communication method (second communication method or a so-called polling method) capable of sequential communication is adopted in which the plurality of indoor units 21 can sequentially communicate with the remote controller 42.

Figure 2:
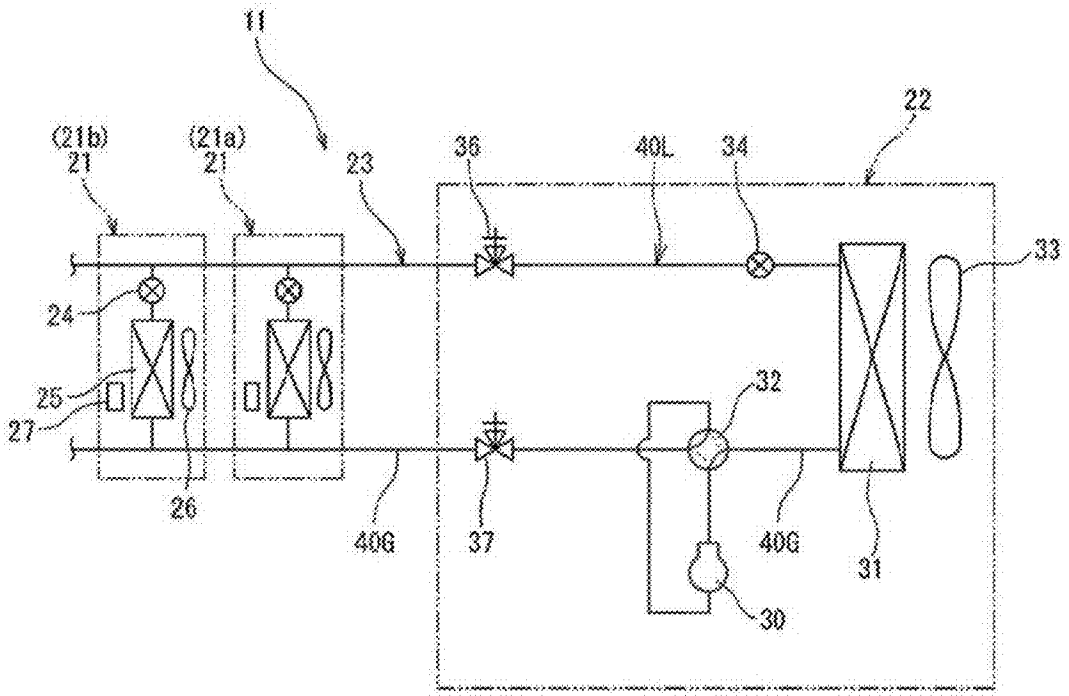
FIG. 2 is a schematic configuration diagram showing a refrigerant circuit of an air conditioner.

FIG. 2 is a schematic configuration diagram showing a refrigerant circuit of the air conditioner.

The air conditioner 11 performs vapor compression refrigeration cycle operation by circulating a refrigerant through a refrigerant circuit 23. In the present embodiment, as the refrigerant, a refrigerant having a property such as flammability, slight flammability, toxicity, or greenhouse effect, for example, an R32 refrigerant is used.

The refrigerant circuit 23 includes a compressor 30, a four-way switching valve 32, an outdoor heat exchanger (heat source heat exchanger) 31, an outdoor expansion valve 34, a liquid shutoff valve 36, indoor expansion valves 24, indoor heat exchangers (utilization heat exchangers) 25, a gas shutoff valve 37, and refrigerant pipes 40L and 40G connecting these elements.

The indoor unit 21 includes the indoor expansion valve 24 and the indoor heat exchanger 25 constituting the refrigerant circuit 23. The indoor expansion valve 24 includes an electric expansion valve capable of adjusting a refrigerant pressure and a refrigerant flow rate. The indoor heat exchanger 25 is of a cross-fin tube type or a microchannel type, and is used for heat exchange with indoor air.

The indoor unit 21 further includes an indoor fan 26 and a refrigerant sensor 27. The indoor fan 26 is configured to take indoor air into the indoor unit 21, cause the indoor heat exchanger 25 to exchange heat with the taken-in air, and then blow the air into an indoor space. The indoor fan 26 includes a motor having a number of operating rotations adjustable in accordance with inverter control.

The refrigerant sensor 27 detects a refrigerant leaking from the refrigerant circuit 23. The refrigerant sensor 27 is provided near a refrigerant pipe inside the indoor unit 21. Alternatively, the refrigerant sensor 27 may be provided in the remote controller 42 to be described below, a ceiling, a wall, a floor, or the like in the indoor space.

The outdoor unit 22 includes the compressor 30, the four-way switching valve 32, the outdoor heat exchanger 31, the outdoor expansion valve 34, the liquid shutoff valve 36, and the gas shutoff valve 37 that are included in the refrigerant circuit 23.

The compressor 30 sucks a low-pressure gas refrigerant and discharges a high-pressure gas refrigerant. The compressor 30 includes a motor having a number of operating rotations adjustable in accordance with inverter control. The compressor 30 is of a variable capacity type (performance variable type) having capacity (performance) variable in accordance with inverter control of the motor. Alternatively, the compressor 30 may be of a constant capacity type. There may alternatively be provided a plurality of compressors 30. In this case, compressors of a variable capacity type and compressors of a constant capacity type may coexist.

The four-way switching valve 32 reverses a refrigerant flow in the refrigerant pipe, and switches and supplies the refrigerant discharged from the compressor 30 to either the outdoor heat exchanger 31 or the indoor heat exchanger 25. As a result, the air conditioner 11 can switch between a cooling operation and a heating operation.

The outdoor heat exchanger 31 is, for example, a cross fin tube type or microchannel type heat exchanger, and is used for exchanging heat with a refrigerant by using air as a heat source. The outdoor expansion valve 34 includes an electric expansion valve capable of adjusting the refrigerant pressure and the refrigerant flow rate. The liquid shutoff valve 36 is a manually operated on-off valve. The gas shutoff valve 37 is also a manually operated on-off valve.

The outdoor unit 22 further includes an outdoor fan 33. The outdoor fan 33 includes a motor having a number of operating rotations adjustable in accordance with inverter control. The outdoor fan 33 is configured to take outdoor air into the outdoor unit 22, cause the outdoor heat exchanger 31 to exchange heat with the taken-in air, and then blow the air out of the outdoor unit 22.

When the air conditioner 11 thus configured performs the cooling operation, the four-way switching valve 32 is maintained in a state indicated by solid lines in FIG. 2. A high-temperature and high-pressure gaseous refrigerant discharged from the compressor 30 flows into the outdoor heat exchanger 31 through the four-way switching valve 32, and exchanges heat with outdoor air by operation of the outdoor fan 33 to dissipate heat. The refrigerant having dissipated heat passes through the outdoor expansion valve 34 in a fully open state and flows into each indoor unit 21. The refrigerant in the indoor unit 21 is decompressed to have predetermined low pressure at the indoor expansion valve 24, and further exchanges heat with indoor air in the indoor heat exchanger 25 to be evaporated. The indoor fan 26 causes the indoor air cooled due to evaporation of the refrigerant to blow indoors so as to cool the indoor space. The refrigerant evaporated in the indoor heat exchanger 25 returns to the outdoor unit 22 via the gas refrigerant pipe 40G, passes through the four-way switching valve 32, and is sucked into the compressor 30.

When the air conditioner 11 performs the heating operation, the four-way switching valve 32 is maintained in a state indicated by broken lines in FIG. 2. The high-temperature and high-pressure gas refrigerant discharged from the compressor 30 passes through the four-way switching valve 32 and flows into the indoor heat exchanger 25 of each of the indoor units 21. In the indoor heat exchanger 25, the refrigerant exchanges heat with indoor air to dissipate heat. The indoor air heated by the heat dissipation of the refrigerant is blown into the indoor space by the indoor fan 26 to heat the indoor space. The refrigerant liquefied in the indoor heat exchanger 25 returns to the outdoor unit 22 through the liquid refrigerant pipe 40L, is decompressed to a predetermined low pressure by the outdoor expansion valve 34, and further exchanges heat with outdoor air in the outdoor heat exchanger 31 to evaporate. The refrigerant evaporated and vaporized by the outdoor heat exchanger 31 is sucked into the compressor 30 through the four-way switching valve 32.

Figure 3:
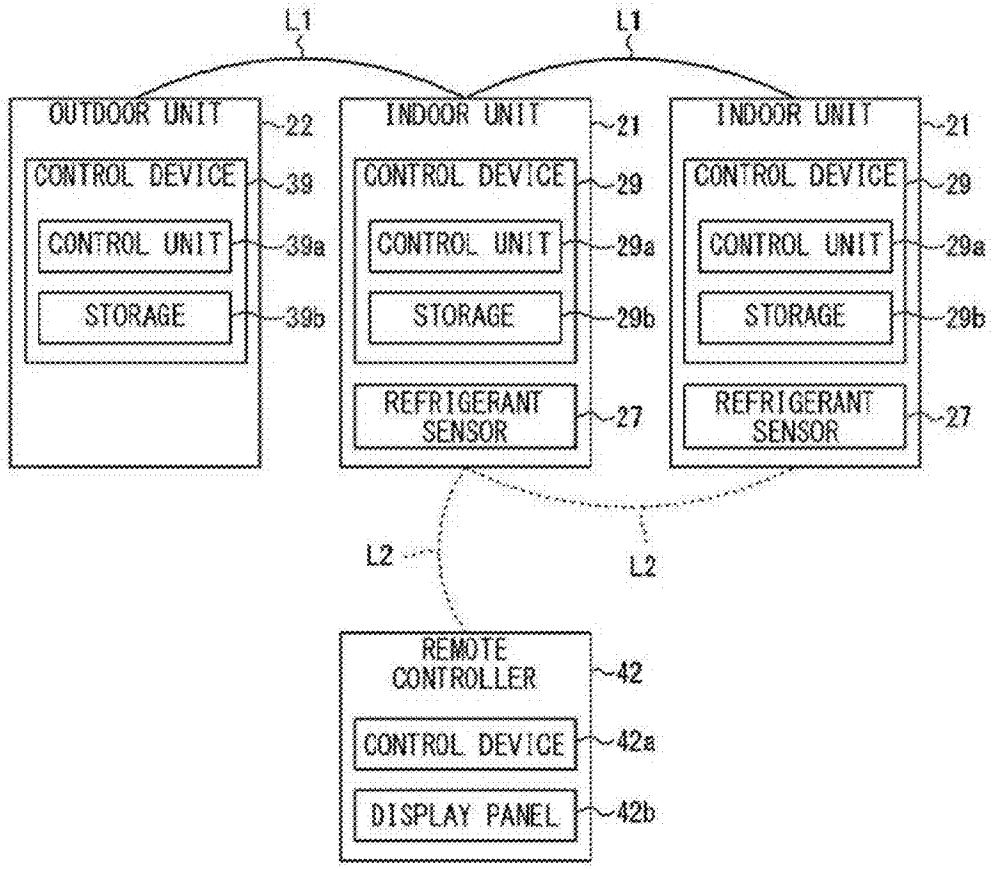
FIG. 3 is a block diagram of a control system of the air conditioner.

FIG. 3 is a block diagram of a control system of the air conditioner.

The indoor unit 21 includes a control device 29 as a control system component. The control device 29 includes a microcomputer or the like having a control unit 29*a* such as a CPU and a storage 29*b* such as a RAM or a ROM. The control device 29 may include an integrated circuit such as an FPGA or an ASIC. The control device 29 controls the operation of the indoor fan 26 and the indoor expansion valve 24 described above. The control device 29 also receives a signal transmitted from the refrigerant sensor 27. The refrigerant sensor 27 transmits a detection signal of the refrigerant leaking from the refrigerant circuit 23 to the control device 29.

The remote controller 42 is communicably connected to the control device 29 in the indoor unit 21. A user can operate the remote controller 42 to turn on or off the air conditioner 11, to input set temperature, and the like. The remote controller 42 according to the embodiment includes a control device 42*a* and a display panel (display unit) 42*b*. The control device 42*a* includes a microcomputer or the like having a control unit such as a CPU and a storage such as a RAM or a ROM. The control device 42*a* may include an integrated circuit such as an FPGA or an ASIC. As will be described later, the display panel 42*b* functions as a notification unit that notifies that the refrigerant has been detected by the refrigerant sensor 27.

The outdoor unit 22 includes the control device 39. The control device 39 includes a microcomputer or the like having a control unit 39*a* such as a CPU and a storage 39*b* such as a RAM or a ROM. The control device 39 may include an integrated circuit such as an FPGA or an ASIC. The control device 39 controls operations of the compressor 30, the outdoor fan 33, and the outdoor expansion valve 34. The control device 39 transmits a control signal for controlling the operations of the indoor fan 26 and the indoor expansion valve 24 of each of the plurality of indoor units 21 to the control device 29 of the indoor unit 21.

[Notification of Refrigerant Leak]

In the present embodiment, for example, the slightly flammable R32 refrigerant is used as the refrigerant. Therefore, when the refrigerant leaks from the refrigerant circuit 23 of the indoor unit 21, it is desirable to notify the user or the like of the leak as soon as possible. In the present embodiment, when the refrigerant sensor 27 detects the refrigerant, the information (leak detection information) is transmitted from the control device 29 of the indoor unit 21 to the control device 42*a* of the remote controller 42, and an alarm is displayed on the display panel 42*b* of the remote controller 42. It is therefore possible to notify the user who uses the room of a refrigerant leak.

Regarding the notification of the refrigerant leak as described above, the air conditioning system 10 including the plurality of indoor units 21 and the remote controller 42 potentially has the following problems.

(First Problem)

Standard of air conditioner in Japan (Standard of Japan Refrigeration and Air Conditioning Industry Association (JRA Standard)) requires notifying a building manager or the like when a refrigerant leak occurs. In a large-scale building, since all air conditioners are managed collectively by a centralized management device in many cases, when a refrigerant leak occurs in any one of the indoor units 21, the centralized management device can receive the information and notify the manager of the information. However, small and medium-scale buildings and the like often do not include such a centralized management device, and thus have a difficulty in notifying the manager or the like of the refrigerant leak. Therefore, there is a possibility that a response to the refrigerant leak is delayed.

(Second Problem)

When the plurality of indoor units 21 communicates with the remote controller 42 by the polling method as in the air conditioning system 10 according to the present embodiment, the indoor units 21 cannot necessarily immediately communicate with the remote controller 42 at the time of detection of the refrigerant leak, and performs communication when its turn comes. Therefore, there is a possibility that notification by the remote controller 42 is delayed.

The air conditioning system 10 according to the present embodiment takes the following measures in view of the first and second problems.

First, regarding the first problem, in the air conditioning system 10 according to the present embodiment, any of the remote controllers 42 is configured to be settable for management. The user or a contractor can perform management setting on the specific remote controller 42 when or after the air conditioning system 10 is installed. The management setting gives the specific remote controller 42 an authority (hereinafter, also referred to as "notification authority") to make a notification of the refrigerant leak on the basis of the detection of the refrigerant received from other than the refrigerant sensor 27 of the indoor unit 21 connected to the remote controller 42.

For example, when the indoor unit 21 installed in a manager's room of a building and the remote controller 42 of the indoor unit 21 are set for management and the notification authority is given to the remote controller 42, the remote controller 42 set for management can make a notification of the refrigerant leak detected in another indoor unit 21 other than the group to which the remote controller 42 belongs, and the manager in the management room can be immediately notified of the occurrence of the refrigerant leak.

Regarding the second problem, the air conditioning system 10 according to the present embodiment is configured to be able to instruct the remote controller 42 to make a notification of the refrigerant leak from all the indoor units 21 included in the group when the refrigerant is detected in any of the plurality of indoor units 21 in each group. Therefore, regardless of the order of communication with the remote controller 42, the indoor unit 21 that first communicates with the remote controller 42 in the group can instruct the remote controller 42 to make a notification of a refrigerant leak, and the remote controller 42 can make a notification of the refrigerant leak and notify the user in the indoor space of the refrigerant leak without delay.

Specific details of notification of a refrigerant leak will be described below.

Figure 4:
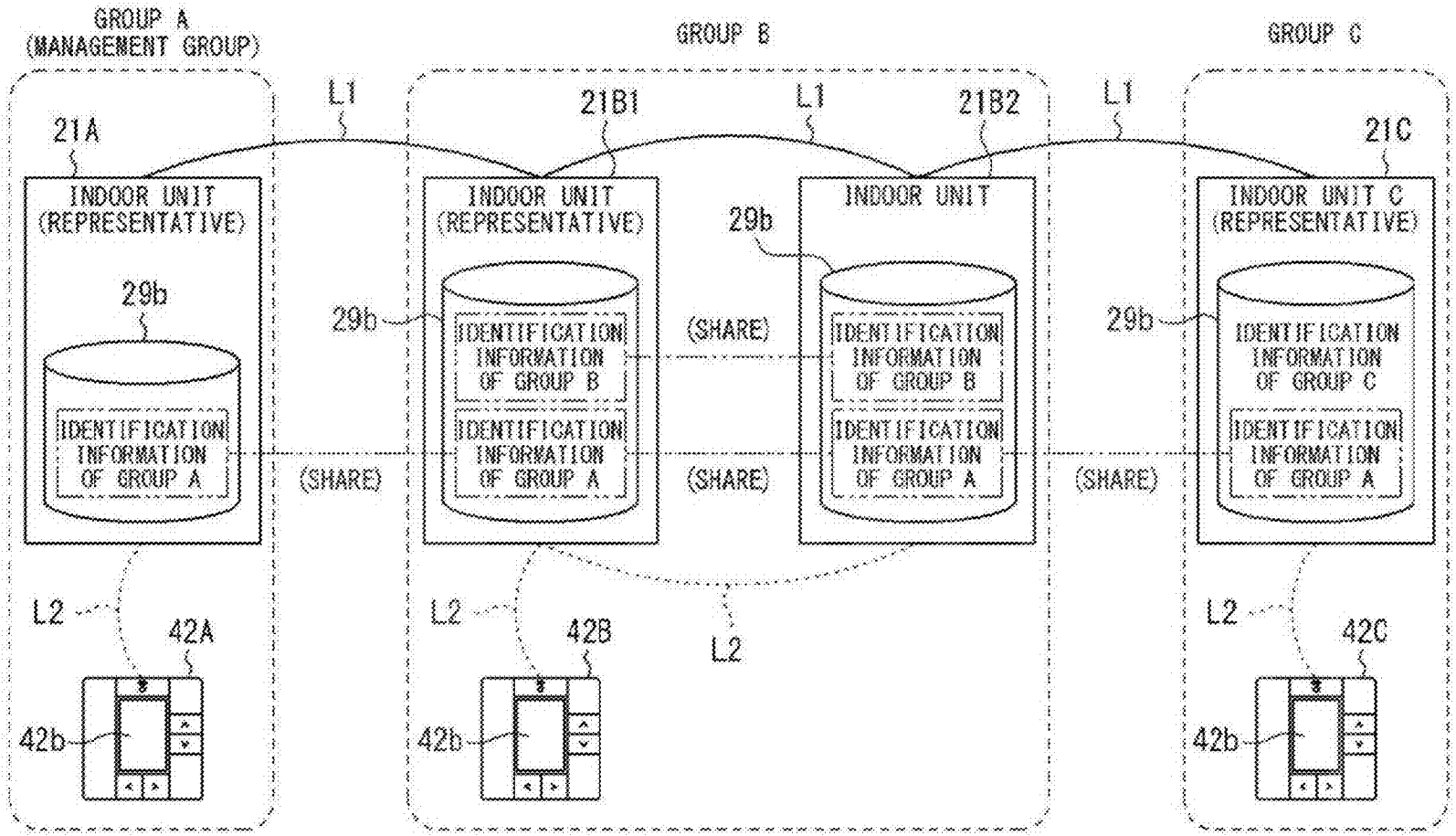
FIG. 4 is a block diagram for describing a mechanism of notification of a refrigerant leak.

FIG. 4 is a block diagram for describing a mechanism of notification of a refrigerant leak. In FIG. 4, some groups A, B, and C included in the air conditioning system 10 are extracted and illustrated. Each of the groups A, B, and C includes one or a plurality of indoor units 21A, 21B1, 21B2, and 21C and remote controllers 42A, 42B, and 42C. Although only one indoor unit 21A or 21C is illustrated in the group A and the group C, a plurality of indoor units may be included.

In the example illustrated in FIG. 4, the indoor unit 21A and the remote controller 42A included in the group A are set for management. The indoor unit 21A and the remote controller 42A included in the group A can be installed in, for example, a management room of a building.

The storages 29*b* of the indoor units 21A, 21B1, 21B2, and 21C included in the groups A, B, and C store identification information for specifying the groups A, B, and C to which the indoor units 21A, 21B1, 21B2, and 21C belong. For example, the indoor unit 21A of the group A stores identification information of the group A. The indoor units 21B1 and 21B2 of the group B store identification information of the group B. The indoor unit 21C of the group C stores identification information of the group C. The same identification information is shared by the indoor units 21B1 and 21B2 which belong to the same group B.

The storages 29*b* of the indoor units 21B1, 21B2, and 21C in the groups B and C belonging to groups other than the management group A store the identification information of the group A set for management in addition to the identification information of their own groups B and C. Therefore, the identification information of the management group A is shared by all the indoor units 21A, 21B1,21B2, and 21C.

In the air conditioning system 10 according to the present embodiment, a model name and a device number of the indoor unit included in each of the groups A, B, and C are used as the identification information of each of the groups A, B, and C. Specifically, in the air conditioning system 10 according to the present embodiment, in each of the groups A, B, and C, the model names and the device numbers of the representative indoor units 21A, 21B1, and 21C are adopted as the identification information. The representative indoor unit is an indoor unit generally called a "master unit", and for example, an indoor unit that supplies power to the remote controller 42 is adopted. The device number is a unique number assigned to each indoor unit 21, and corresponds to, for example, a manufacturing number, a communication address, or the like.

Figure 5:
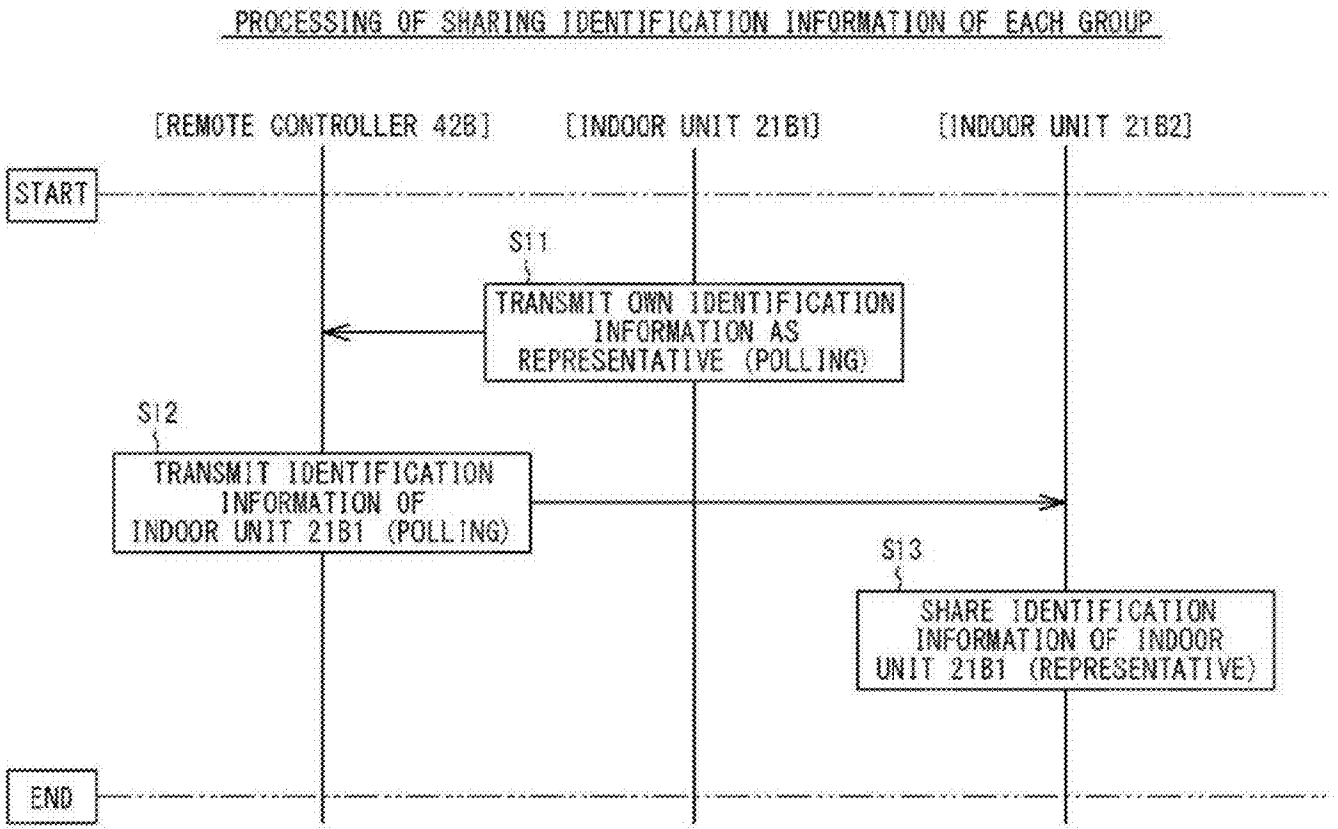
FIG. 5 is a flowchart of a processing procedure for sharing identification information of each group among a plurality of indoor units.

FIG. 5 is a flowchart of a processing procedure for sharing the identification information of each group among the plurality of indoor units.

In FIG. 5, as an example, a procedure for sharing the identification information among the plurality of indoor units 21B1 and 21B2 in the group B in FIG. 4 will be described.

First, the indoor unit 21B1 as a representative in the group B transmits the identification information (model name and device number) of the indoor unit 21B1 to the remote controller 42B (step S11). This transmission of the identification information is performed by communication by the polling method.

Upon receiving the identification information, the remote controller 42B transmits the identification information of the representative indoor unit 21B1 to the other indoor unit 21B2 in the group B (step S12). This transmission of the identification information is also performed by communication by the polling method.

The other indoor unit 21B2 that has received the identification information stores the identification information in the storage 29*b* and shares the identification information of the indoor unit 21B1 (step S13).

Figure 6:
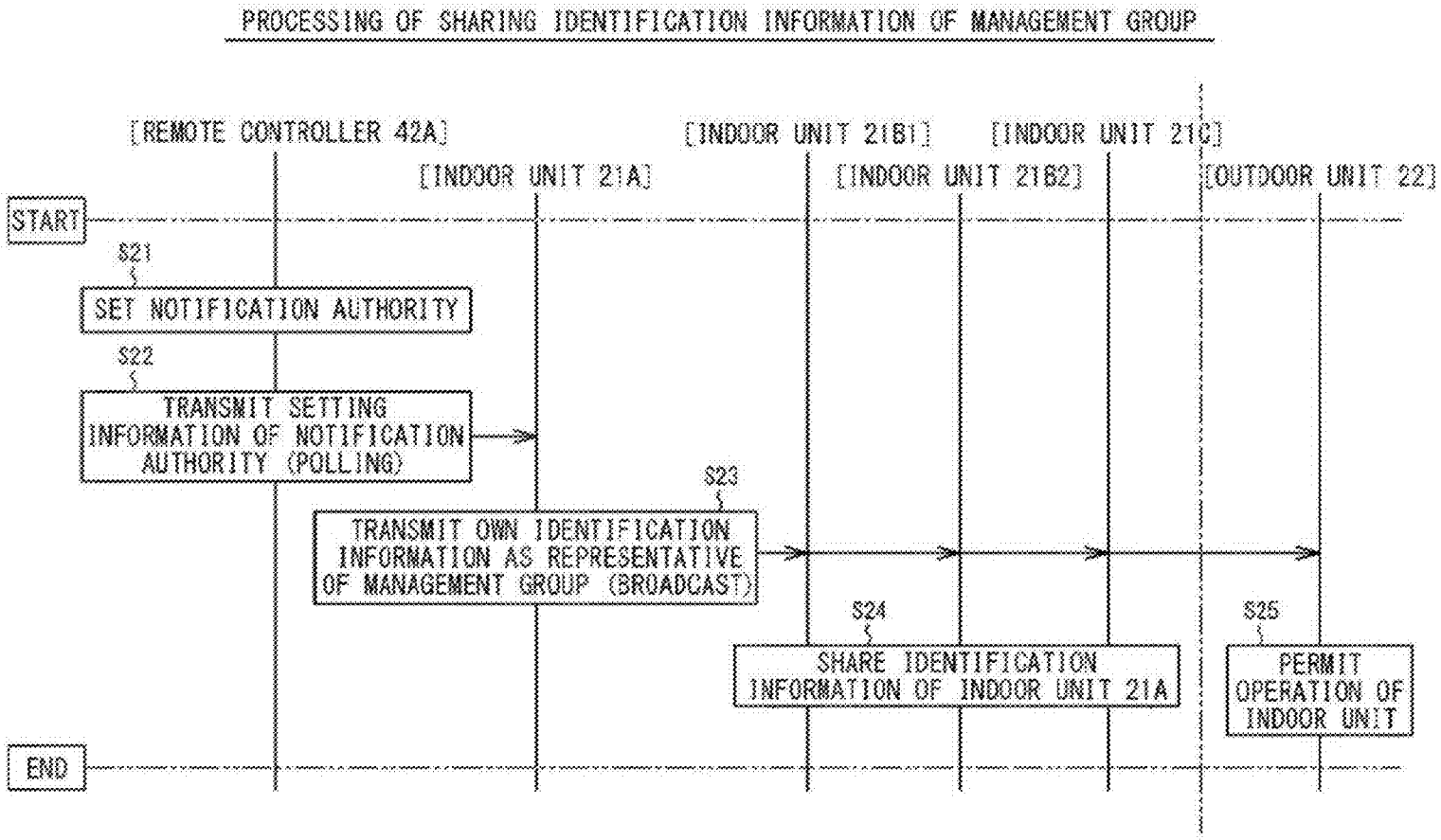
FIG. 6 is a flowchart of a processing procedure for sharing identification information of a management group among a plurality of indoor units.

FIG. 6 is a flowchart of a processing procedure for sharing the identification information of the management group among the plurality of indoor units.

As an example, a case will be described where the notification authority is set to the remote controller 42A of the group A.

When a construction company or a service engineer performs setting for giving the notification authority to the remote controller 42A included in the group A (step S21), the remote controller 42A transmits information (setting information) indicating that the notification authority has been set to the indoor unit 21A which is a representative of the group A (step S22). This transmission is performed by communication by the polling method.

Next, the indoor unit 21A having received the setting information transmits the model name and device number of the indoor unit 21A, which are identification information of the group A, to the other indoor units 21B1, 21B2, and 21C as a representative of the management group A (step S23). This transmission is performed by communication by a broadcast method. Therefore, the identification information of the indoor unit 21A set for management is also transmitted to the outdoor unit 22. The handling of the identification information transmitted to the outdoor unit 22 will be described later.

The other indoor units 21B1, 21B2, and 21C store the received identification information of the management group A in the storage 29*b*, and all the indoor units 21A, 21B1, 21B2, and 21C share the identification information (step S24).

Figure 7:
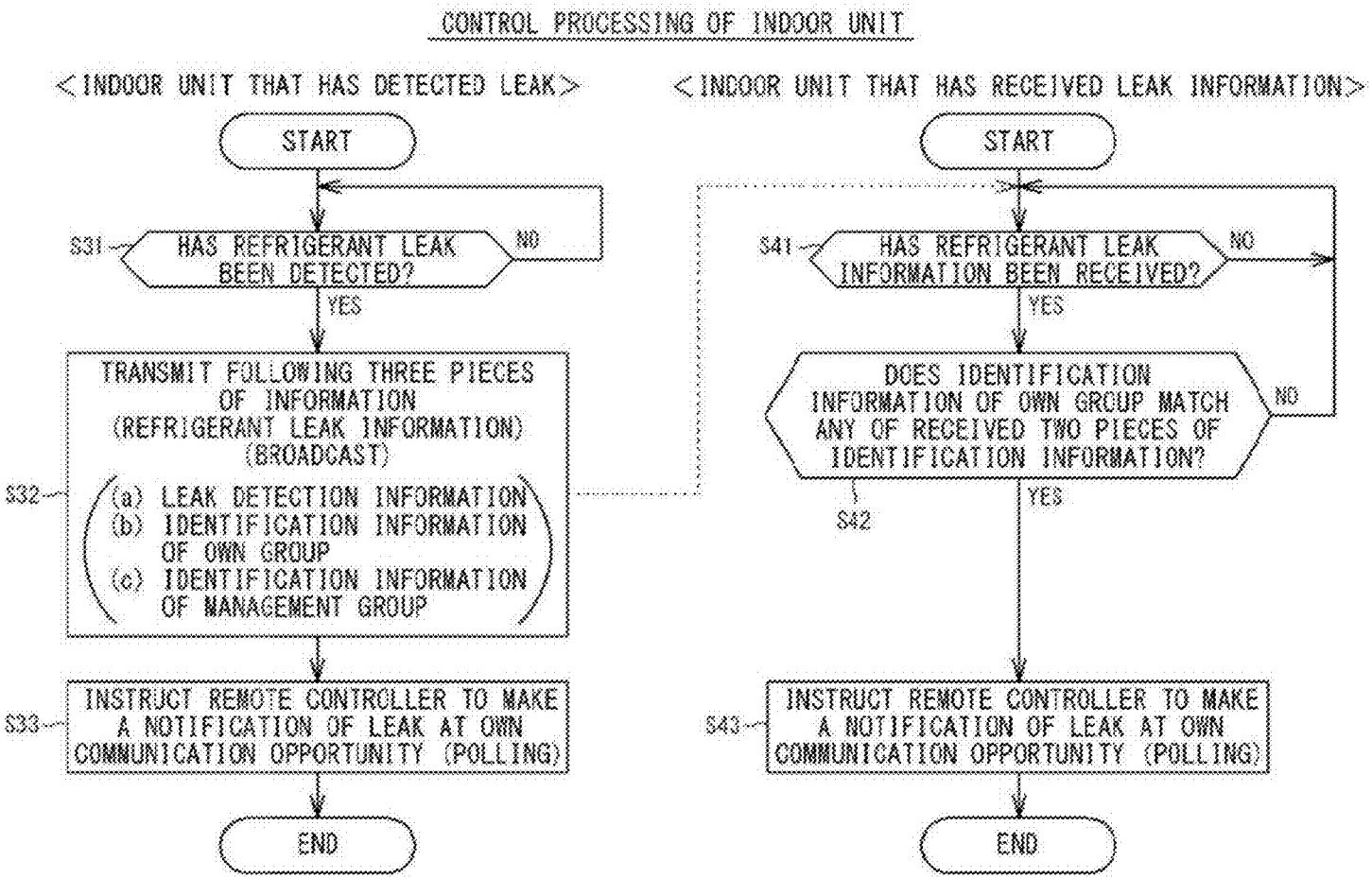
FIG. 7 is a flowchart of a control procedure of an indoor unit.

FIG. 7 is a flowchart illustrating a control procedure of the indoor unit. FIG. 7 illustrates control procedures of both the indoor unit 21 that has detected a refrigerant leak and the indoor unit 21 that has received information indicating a refrigerant leak from another indoor unit 21. This control procedure is performed by the control device 29 of the indoor unit 21.

Each indoor unit 21 of the air conditioning system 10 determines whether the refrigerant leaking from the refrigerant sensor 27 has been detected (step S31). When the determination in step S31 is affirmative (Yes), the indoor unit 21 transmits the refrigerant leak information including the following three pieces of information (a) to (c) to the other indoor units 21 by the broadcast method.

(a) Information indicating that refrigerant leak has been detected (leak detection information)

(b) Identification information of own group (c) Identification information of management group The information (a) is a signal generated when the refrigerant leaks from the indoor unit 21 and the refrigerant sensor 27 provided in the indoor unit 21 detects the refrigerant, and is also called a leak flag. The indoor unit 21 that has received the leak detection information can recognize that the refrigerant leaks from another indoor unit 21 other than the indoor unit itself.

As described above, the information (b) is identification information (model name and device number) of the representative indoor unit 21 shared in the group by the procedure illustrated in FIG. 5. The information (c) is identification information (model name and device number) of the representative indoor unit 21 in the management group shared by all the indoor units 21 in accordance with the procedure illustrated in FIG. 6.

When a communication opportunity with the remote controller 42 comes by the polling method, the indoor unit 21 that has detected the refrigerant leak instructs the remote controller 42 to make a notification of the refrigerant leak (step S33).

On the other hand, each indoor unit 21 of the air conditioning system 10 determines whether the refrigerant leak information has been received from the other indoor units 21 (step S41). When the determination in step S41 is affirmative (Yes), the indoor unit 21 compares the identification information of the group to which the indoor unit 21 belongs with the two pieces of transmitted identification information (step S42). When the determination in step S42 is affirmative (Yes), the processing proceeds to step S43, and when the determination is negative (No), the processing returns to step S41.

When the indoor unit 21 receives the identification information that matches the identification information of its own group among the refrigerant leak information in step S42, the indoor unit 21 can recognize that the refrigerant leaks from the other indoor units 21 in the same group as the indoor unit 21. For example, when the indoor unit 21B1 illustrated in FIG. 4 transmits the refrigerant leak information (leak detection information and identification information of the group A and the group B) and the indoor unit 21B2 receives the refrigerant leak information, the indoor unit 21B2 compares the identification information of its own group B with the received identification information of the group A and the group B. Since the indoor unit 21B2 has received the identification information that matches the identification information of its own group B, the indoor unit 21B2 can recognize that the refrigerant leaks from the other indoor unit 21B1 in the same group B.

When a communication opportunity with the remote controller 42 comes by the polling method in step S43 in FIG. 7, the indoor unit 21 instructs the remote controller 42 to make a notification of the refrigerant leak. As a result, both the indoor unit 21 in which the refrigerant has leaked and the other indoor units 21 in the same group can instruct the remote controller 42 in the group to make a notification of the refrigerant leak (steps S33 and S43). Therefore, after the refrigerant is detected, the indoor unit 21 that first becomes communicable with the remote controller 42 can instruct the remote controller 42 to make a notification of the refrigerant leak, and can prevent delay in notification of the refrigerant leak by the remote controller 42.

On the other hand, when the indoor unit 21B1 illustrated in FIG. 4 transmits the refrigerant leak information (leak detection information and identification information of the group A and the group B) and the indoor unit 21A in the management group A receives the refrigerant leak information, the indoor unit 21A compares the identification information of its own group A with the received identification information of the group A and the group B (step S42). Since the indoor unit 21A has received the identification information that matches the identification information of its own group A, the indoor unit 21A instructs the remote controller 42A in the management group A to make a notification of the refrigerant leak at its own communication opportunity in step S43 in FIG. 7. By the notification from the remote controller 42A in the management group A, a manager in a management room of a building or the like can confirm that a refrigerant leak occurs in any one of the indoor units 21 in the air conditioning system 10, and can take an appropriate measure against the refrigerant leak.

When a plurality of indoor units 21A is included in the management group A, all the indoor units 21A receive the identification information that matches the identification information of their own group A. Thus, the indoor units 21A each instruct the remote controller 42A in the management group A to make a notification of the refrigerant leak at their own communication opportunity. Therefore, after the refrigerant is detected, the indoor unit 21A that first becomes communicable with the remote controller 42A can instruct to make a notification of the refrigerant leak, and can prevent delay in notification by the remote controller 42A. Even if the indoor unit 21C illustrated in FIG. 4 receives the refrigerant leak information transmitted from the indoor unit 21B1, the identification information of its own group C does not match the received identification information of the groups A and B, and thus, does not instruct the remote controller 42C to make a notification. Therefore, the processing returns from step S42 to step S41 in FIG. 7.

[Interlock Function by Outdoor Unit]

The air conditioning system 10 according to the present embodiment has an interlock function that permits the operation of the indoor unit 21 in conjunction with the notification authority set to any of the plurality of remote controllers 42. For example, in step S23 in FIG. 6, the outdoor unit 22 receives the identification information transmitted from the indoor unit 21A, which is the representative of the management group A, by the broadcast method. The outdoor unit 22 can confirm that the notification authority has been given to any of the remote controllers 42 by receiving the identification information, and can permit the operation of the indoor unit 21 on the basis of the reception of the identification information.

If the operation of the indoor unit 21 is permitted in a state where the notification authority is not set for any of the remote controllers 42, it is impossible to notify the manager of the occurrence of the refrigerant leak, and it is difficult to comply with the JRA standard. In the air conditioning system 10 according to the present embodiment, the operation of the indoor unit 21 is not permitted unless the notification authority is set to any of the remote controllers 42. Therefore, the air conditioning system 10 can be prevented from operating in a state where the notification authority is not set. It is also possible to prevent setting of the notification authority from being forgotten.

The control device 39 of the outdoor unit 22 can permit the operation of the indoor unit 21 by setting the notification authority to at least one remote controller 42 in the air conditioning system 10.

The interlock function as described above may be provided in the control device 29 of the indoor unit 21. In this case, when the notification authority is set to any of the remote controllers 42, the control device 29 of the indoor unit 21 permits the operation of the indoor unit 21. However, in this case, even if a communication failure occurs between the indoor unit 21 and the outdoor unit 22, the control device 29 can recognize that the notification authority has been set to the remote controller 42. Therefore, there is a possibility that the control device 29 can permit the operation of the indoor unit 21 other than the outdoor unit 22. In the present embodiment, since the control device 39 of the outdoor unit 22 has an interlock function, such an inconvenience does not occur.

OTHER EMBODIMENTS

In the air conditioning system 10 described above, the refrigerant sensor 27 is provided in the indoor unit 21 of the air conditioner 11, and the notification of the refrigerant leak in the indoor unit 21 is made. However, in the air conditioning system 10 of the present disclosure, in addition to or instead of the indoor unit 21, a refrigerant sensor may detect a refrigerant leak in another device through which the refrigerant flows, for example, an outside air processor or a ventilator, and a remote controller may make a notification of the refrigerant leak.

In the above embodiment, the notification of the refrigerant leak is made by using the display panel 42*b* of the remote controller 42, but the present disclosure is not limited to this configuration, and the notification of the refrigerant leak may be made by light or sound by using a light or a buzzer provided in the remote controller 42. A notification device for making a notification of a refrigerant leak is not limited to the remote controller 42, and may be constituted by a device dedicated to notification.

The identification information of each of the groups A, B, and C is not limited to the model name and the device number of the representative indoor units 21A, 21B1, and 21C, and may be a model name and a device number of an indoor unit other than the representative indoor unit. The identification information may include only one of the model name or the device number.

The notification authority for management can be set for all the remote controllers 42 in the air conditioning system 10. Therefore, the notification authority for management can be set by selecting any one or plurality of remote controllers 42 from all the remote controllers 42. As a result, it is possible to notify only necessary persons such as a manager and a person in a specific room of the refrigerant leak. The interlock function of permitting operation of the indoor unit 21 in conjunction with the setting of the notification authority is only required to function when the notification authority is set for at least one remote controller 42.

Action and Effects of Embodiments

As a communication method of the plurality of indoor units and the remote controller, a polling method in which the plurality of indoor units sequentially communicate with the remote controller is often adopted. The method is adopted in consideration of data collision prevention and system construction cost. However, in this communication method, even if a refrigerant leak is detected in a certain indoor unit, the refrigerant leak may not be immediately transmitted to the remote controller, and there is a possibility that a notification of the refrigerant leak by the remote controller is delayed. This problem becomes more significant as the number of indoor units connected to the remote controller increases. An object of the present disclosure is to provide an air conditioning system capable of promptly instructing a notification device such as a remote controller to make a notification of a refrigerant leak.

Action and Effects (1) The air conditioning system 10 according to the present embodiment includes a first device (for example, the indoor unit 21A or the indoor unit 21B2 in FIG. 4), a second device (for example, the indoor unit 21B1 in FIG. 4) that is communicably connected to the first device 21A or 21B2 and through which a refrigerant flows, the refrigerant sensor 27 that is provided in the second device 21B1 and detects a refrigerant leaking at the second device 21B1, and a first notification device (for example, the remote controller 42A or the remote controller 42B) that is communicably connected to the first device 21A or 21B2 and makes a notification of a refrigerant leak. The first device 21A or 21B2 and the second device 21B1 share first identification information (for example, the identification information of the group A or the identification information of the group B) that specifies a first group (for example, the group A or the group B) including the first notification device 42A or 42B and the first device 21A or 21B2. The second device 21B1 transmits the leak detection information indicating detection of a refrigerant leak and the first identification information to the first device 21A or 21B2 on the basis of detection of the refrigerant leak by the refrigerant sensor 27. The first device 21A or 21B2 instructs the first notification device 42A or 42B to make a notification of the refrigerant leak on the basis of reception of the leak detection information and the first identification information that matches the identification information of the group A or B to which the first device 21A or 21B2 itself belongs.

In a case where the first device is the indoor unit 21B2 in FIG. 4 and the first notification device is the remote controller 42B in FIG. 4, when the refrigerant leaks at the second device 21B1 in the air conditioning system 10, the first device 21B2 that has received the leak detection information can instruct the first notification device 42B to make a notification of the refrigerant leak. Therefore, when the first device 21B2 can communicate with the first notification device 42B earlier than the second device 21B1, a notification of the refrigerant leak can be made earlier. In a case where the first device is the indoor unit 21A in FIG. 4 and the first notification device is the remote controller 42A in FIG. 4, if the remote controller 42A is set for management, the manager can be promptly notified of the refrigerant leak.

(2) In FIG. 4, in a case where the first device is the indoor unit 21B2, the first notification device is the remote controller 42B, and the first group is the group B, in the above embodiment, the second device 21B1 is communicably connected to the first notification device 42B and is included in the first group B, and instructs the first notification device 42B to make a notification of the refrigerant leak on the basis of detection of the refrigerant leak by the refrigerant sensor 27. In this case, one of the first device 21B2 or the second device 21B1 that has been able to communicate with the first notification device 42B earlier can instruct to make a notification earlier.

(3) In the case of (2), in the above embodiment, the first notification device 42B is a remote controller that operates the first device 21B2 and the second device 21B1. Accordingly, a notification of the refrigerant leak can be made by using the remote controller 42B that operates the first device 21B2 and the second device 21B1.

(4) In the case of (2), the first identification information is information indicating a model name or a device number of the first device 21B2 or the second device 21B1. In this manner, the first identification information of the group B including the first device 21B2 and the second device 21B1 can be set by using the model name or the device number originally assigned to the first device 21B2 or the second device 21B1.

(5) In FIG. 4, in a case where the first device is the indoor unit 21A, the first notification device is the remote controller 42A, and the first group is the group A, in the above embodiment, the air conditioning system 10 further includes a second notification device (for example, the remote controller 42B) communicably connected to the second device 21B1, and the second device 21B1 and the second notification device 42B are included in a second group B different from the first group A. In this case, a notification of the refrigerant leak can be made by the first notification device 42A not connected to the second device 21B1 in which the refrigerant has leaked. Therefore, by setting the device and the notification device installed in a management room as the first device 21A and the first notification device 42A, a manager can be notified of the refrigerant leak.

(6) In the case of (5), setting for making a notification of the refrigerant leak of the second device 21B1, in other words, setting of the notification authority is performed on the first notification device 42A when or after the air conditioning system 10 is installed. As a result, it is possible to set the notification device for management or the like at the site where the air conditioning system is installed.

(7) In the cases of (5) and (6), the air conditioning system 10 further includes a third device (for example, the indoor unit 21B2 in FIG. 4) communicably connected to the first device 21A and the second device 21B1, in which the third device 21B2 is communicably connected to the second notification device 42B and is included in the second group B, the second device 21B1 and the third device 21B2 share the second identification information that specifies the second group B, the second device 21B1 transmits the leak detection information, the first identification information (identification information of the group A), and the second identification information (identification information of the group B) to the first device 21A and the third device 21B2 on the basis of detection of the refrigerant leak by the refrigerant sensor 27 of the second device 21B1, and instructs the second notification device 42B to make a notification of the refrigerant leak, and, the third device 21B2 instructs the second notification device 42B to make a notification of the refrigerant leak on the basis of reception of the leak detection information and the second identification information that matches the identification information of the group B to which the third device 21B2 belongs. As a result, a notification of the refrigerant leak can be made by both the first notification device 42A and the second notification device 42B by transmitting information once from the second device 21B1. A notification to a remote place such as the management room is performed by making a notification from the first notification device 42A, and a notification to a place where the leak actually occurs can be performed by making a notification from the second notification device 42B. One of the second device 21B1 or the third device 21B2 that has been able to communicate with the second notification device 42B earlier can instruct the second notification device 42B to make a notification earlier.

(8) In the cases of (5) to (7), in the above embodiment, the second identification information is information indicating a model name or a device number of the second device 21B1 or the third device 21B2. As a result, the second identification information can be set by using the model name or the device number originally assigned to the second device 21B1 or the third device 21B2.

(9) In the cases of (7) and (8), in the above embodiment, the first device 21A, the second device 21B1, and the third device 21B2 are connected by the first communication method that allows simultaneous communication (broadcast), and the second device 21B1 and the third device 21B2 are connected by the second communication method that allows sequential communication (polling) with the second notification device 42B. In this case, the leak detection information, the first identification information, and the second identification information transmitted from the second device 21B1 can be promptly and simultaneously transmitted to the first device 21A and the third device 21B2 by the first communication method, and either the second device 21B1 or the third device 21B2 connected earlier can instruct the second notification device 42B to make a notification of the refrigerant leak earlier.

(10) In the cases of (5) to (9), in the above embodiment, the second notification device 42B is the remote controller 42B that operates the operation of the second device 21B1 and the third device 21B2. Accordingly, a notification of the refrigerant leak can be made by using the remote controller 42B that operates the second device 21B1 and the third device 21B2.

The present disclosure should not be limited to the above exemplification, but is intended to include any change recited in the claims within meanings and a scope equivalent to those of the claims.

REFERENCE SIGNS LIST

10 air conditioning system
11 air conditioner
21 indoor unit
21A indoor unit (first device)
21B1 indoor unit (second device)
21B2 indoor unit (first device, third device)
21C indoor unit
27 refrigerant sensor
42 remote controller
42A remote controller (notification device)
42B remote controller (notification device)
42C remote controller (notification device)

The invention claimed is:

1. An air conditioning system comprising:
a first device;
a second device that is communicably connected to the first device and through which a refrigerant flows;
a refrigerant sensor that is provided in the second device and detects a refrigerant leaking from the second device; and
a first notification device that is communicably connected to the first device and makes a notification of a refrigerant leak, wherein
the first device and the second device share first identification information that specifies a first group including the first notification device and the first device,
the second device transmits leak detection information and the first identification information to the first device on a basis of detection of the refrigerant leak by the refrigerant sensor,
the first device instructs the first notification device to make a notification of the refrigerant leak on a basis of reception of the leak detection information and the first identification information that matches identification information of a group to which the first device belongs,
each of the first device and the second device includes a heat exchanger,
the first notification device includes a display panel, a light or a buzzer,
the second device is communicably connected to the first notification device, is included in the first group, and instructs the first notification device to make a notification of the refrigerant leak on a basis of detection of the refrigerant leak by the refrigerant sensor, and
communication between the first notification device and the first device and the second device is in a polling method that enables sequential communication.

2. The air conditioning system according to claim 1, wherein the first notification device is a remote controller that operates the first device and the second device.

3. The air conditioning system according to claim 1, wherein the first identification information is information indicating a model name or a device number of the first device or the second device.

4. The air conditioning system according to claim 1, wherein the second device is an indoor unit of an air conditioner.

5. An air conditioning system comprising:
a first device;
a second device that is communicably connected to the first device and through which a refrigerant flows;
a refrigerant sensor that is provided in the second device and detects a refrigerant leaking from the second device;
a first notification device that is communicably connected to the first device and makes a notification of a refrigerant leak; and
a second notification device communicably connected to the second device, wherein
each of the first device and the second device includes a heat exchanger,
each of the first notification device and the second notification device includes a display panel, a light or a buzzer,
the first device and the second device share first identification information that specifies a first group including the first notification device and the first device,
the second device and the second notification device are included in a second group different from the first group,
the second device has second identification information specifying the second group,
based on detection of the refrigerant leak by the refrigerant sensor, the second device transmits leak detection information, the first identification information, and the second identification information to the first device, and
the first device instructs the first notification device to make a notification of the refrigerant leak on a basis of reception of the leak detection information and the first identification information that matches identification information of a group to which the first device belongs.

6. The air conditioning system according to claim 5, wherein setting for making a notification of the refrigerant leak of the second device is performed on the first notification device when or after the air conditioning system is installed.

7. An air conditioning system comprising:

a first device;

a second device that is communicably connected to the first device and through which a refrigerant flows;

a third device communicably connected to the first device and the second device, a refrigerant sensor that is provided in the second device and detects a refrigerant leaking from the second device;

a first notification device that is communicably connected to the first device and makes a notification of a refrigerant leak; and a second notification device communicably connected to the second device, wherein each of the first device, the second device and the third device includes a heat exchanger, each of the first notification device and the second notification device includes a display panel, a light or a buzzer, the first device and the second device share first identification information that specifies a first group including the first notification device and the first device, the second device transmits leak detection information and the first identification information to the first device on a basis of detection of the refrigerant leak by the refrigerant sensor, the first device instructs the first notification device to make a notification of the refrigerant leak on a basis of reception of the leak detection information and the first identification information that matches identification information of a group to which the first device belongs, the second device and the second notification device are included in a second group different from the first group, the third device is communicably connected to the second notification device and is included in the second group, the second device and the third device share second identification information that specifies the second group, the second device transmits leak detection information, the first identification information, and the second identification information to the first device and the third device on a basis of detection of the refrigerant leak by the refrigerant sensor of the second device, and instructs the second notification device to make a notification of the refrigerant leak, and the third device instructs the second notification device to make a notification of the refrigerant leak on a basis of reception of the leak detection information and the second identification information that matches the identification information of the group to which the third device belongs.

8. The air conditioning system according to claim 7, wherein the second identification information is information indicating a model name or a device number of the second device or the third device.

9. The air conditioning system according to claim 7, wherein the first device, the second device, and the third device are connected by a first communication method that allows simultaneous communication, and the second device and the third device are connected by a second communication method that allows sequential communication with the second notification device.

10. The air conditioning system according to claim 7, wherein the second notification device is a remote controller that operates the second device and the third device.

* * * * *